US005201815A

United States Patent [19]

Hong et al.

[11] Patent Number: 5,201,815

[45] Date of Patent: Apr. 13, 1993

[54] ENHANCED OIL RECOVERY METHOD USING AN INVERTED NINE-SPOT PATTERN

[75] Inventors: Ki C. Hong, Orange; Victor M. Ziegler, Bakersfield, both of Calif.

[73] Assignee: Chevron Research and Technology Company, San Francisco, Calif.

[21] Appl. No.: 811,399

[22] Filed: Dec. 20, 1991

[51] Int. Cl.[5] ..... E21B 43/24; E21B 43/30

[52] U.S. Cl. ..... 166/245; 166/272

[58] Field of Search ..... 166/245, 272

[56] References Cited

U.S. PATENT DOCUMENTS

| | | | |
|---|---|---|---|
| 3,872,922 | 3/1975 | Altamira et al. | 166/245 |
| 4,060,129 | 11/1977 | Gomaa et al. | 166/272 X |
| 4,166,501 | 9/1979 | Korstad et al. | 166/263 |
| 4,166,502 | 9/1979 | Hall et al. | 166/272 X |
| 4,166,503 | 9/1979 | Hall et al. | 166/272 X |
| 4,177,752 | 12/1979 | Brown et al. | 166/263 |
| 4,321,966 | 3/1982 | Traverse et al. | 166/272 X |
| 4,458,758 | 7/1984 | Hunt, III et al. | 166/272 |
| 4,515,215 | 5/1985 | Hermes et al. | 166/272 |
| 4,610,301 | 9/1986 | Ghassemi et al. | 166/245 |
| 4,627,493 | 12/1986 | Alameddine | 166/263 |

FOREIGN PATENT DOCUMENTS 1246996 12/1988 Canada .

OTHER PUBLICATIONS

J. L. Restine, W. G. Graves, R. Elias, Jr., "Infill Drilling in a Steamflood Operation: Kern River Field", Sep. 1985, SPE 14337.

*Primary Examiner*—George A. Suchfield

*Attorney, Agent, or Firm*—E. A. Schaal; W. K. Turner

[57] ABSTRACT

In an inverted nine-spot pattern in an areally homogeneous reservoir, oil recovery is enhanced when the completion of the sidewells is restricted to the lower 20% of the reservoir. An inverted nine-spot pattern has a steam injection well at the center of the pattern and production wells at each of the four corners of the pattern and at the center of each side of the pattern. Steam is injected at the center well, and oil is produced from sidewells and corner wells.

5 Claims, 2 Drawing Sheets

ENHANCED OIL RECOVERY METHOD USING AN INVERTED NINE-SPOT PATTERN

The present invention relates to an enhanced oil recovery method using an inverted nine-spot pattern.

BACKGROUND OF THE INVENTION

Inverted nine-spot patterns are commonly used in steamflooding. Those patterns have a steam injection well at the center of the pattern, a production well at each of the four corners of the pattern, and a production well at the center of each side of the pattern. Steam is injected in the center well and oil is produced from the sidewells and corner wells.

In an inverted nine-spot pattern, the injector is closer to the side producer than the corner producer. If both producers are fully completed and the reservoir is areally homogeneous, steam breaks through to the sidewell first, delaying steam propagation toward the corner well. The result is that when a project reaches an economic limit, much oil remains unrecovered, especially in the lower part of the formation near the corner producer.

The effect of sidewell completion on steamflood performance in inverted nine-spot patterns has received little systematic evaltion. A previous simulation study by V. M. Ziegler ["A Comparison of Steamflood Strategies: Five-Spot Pattern vs. Inverted Nine-Spot Pattern," SPE Reservoir Engineering (Nov. 1987) 549–58] indicated that converting a five-spot pattern to an inverted nine-spot by drilling infill producers at the midpoints of the pattern boundaries increases and accelerates oil recovery. Partially completing the infill wells in the lower half of the drive zone was found to give higher oil recovery than that obtained by fully completing the sidewells. This study, however, did not consider the effect of sidewell completion on the performance of a steamflood pattern initially completed as an inverted nine-spot.

U.S. Pat. Nos. 4,166,501 and 4,177,752 disclose methods of improving vertical sweep in a five-spot pattern, but does not address the problem of producing oil from blind spots, such as sidewells.

U.S. Pat. No. 4,458,758 discloses well completion techniques when all producers are assumed to be at the same distance from the injector, but does not address the problem of balancing steam propagation when producers are at different distances.

U.S. Pat. Nos. 4,166,501, 4,177,752, and 4,458,758 are hereby incorporated by reference for all purposes.

SPE Paper 14337, "Infill Drilling in a Steamflood Operation: Kern River Field" discusses field experience with infill drilling which converts five-spot patterns to inverted nine-spots. It mentions no control of sidewell completions. Because steam has broken through to corner wells, there is no need to partially complete them.

SUMMARY OF THE INVENTION

In an areally homogeneous oil reservoir, the completion of sidewells in an inverted nine-spot pattern is restricted to the lower 20% of the reservoir to prevent early breakthrough to sidewells. The completion of the corner wells should be more than 20% complete, preferably fully complete. The completion of the injection well should be restricted to the range of the lower 30% to the lower 50% of the reservoir, preferably to the lower 30% of the reservoir.

BRIEF DESCRIPTION OF THE DRAWINGS

In order to assist the understanding of this invention, reference will now be made to the appended drawings. The drawings are exemplary only, and should not be construed as limiting the invention.

DETAILED DESCRIPTION OF THE INVENTION

Figures 1A, 1B, 1C:
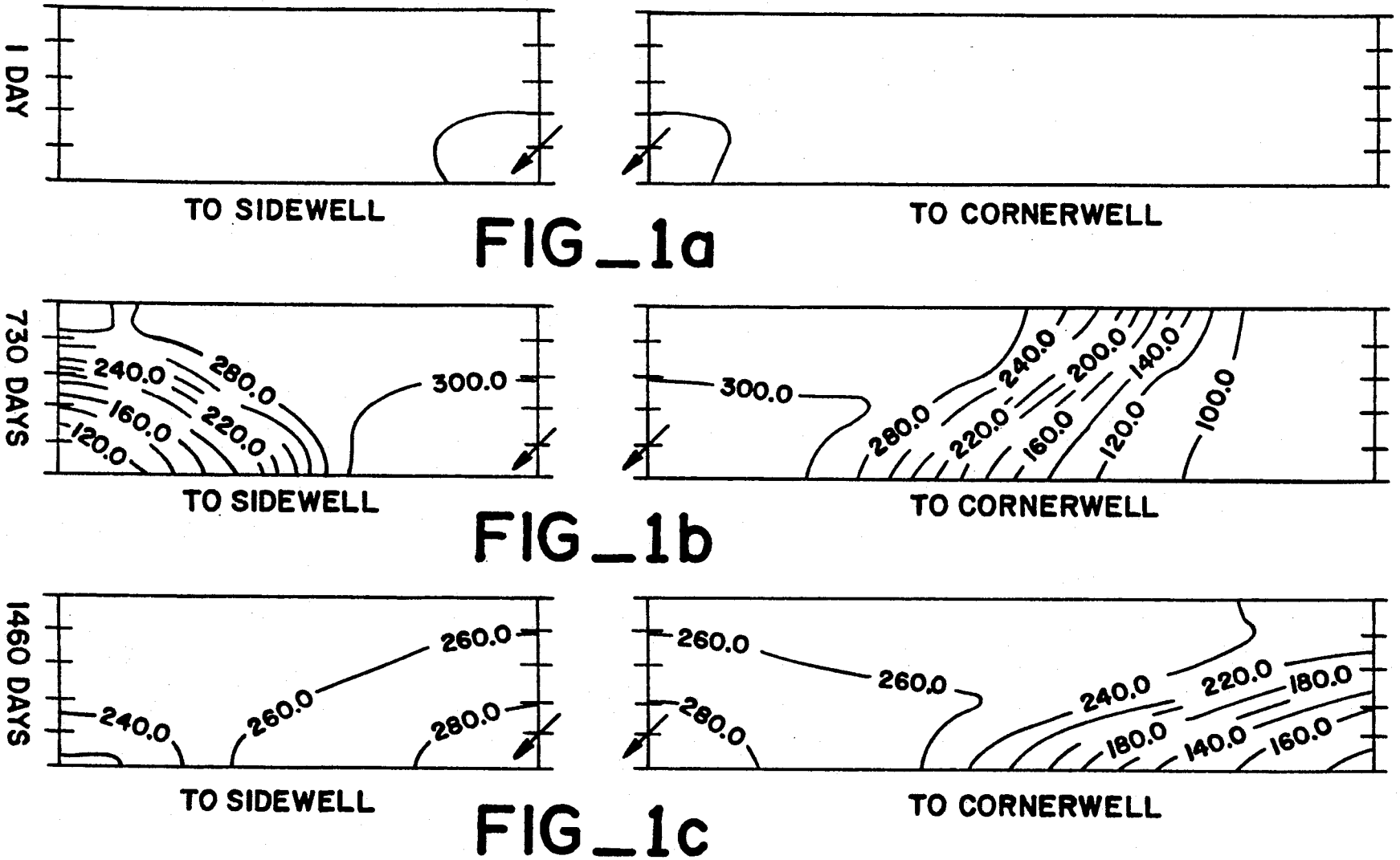
FIGS. 1*a*, 1*b*, 1*c*, 2*a*, 2*b*, and 2*c* show temperature profiles on the vertical planes connecting the injector well with the sidewell and the corner well.
Figure 2A:
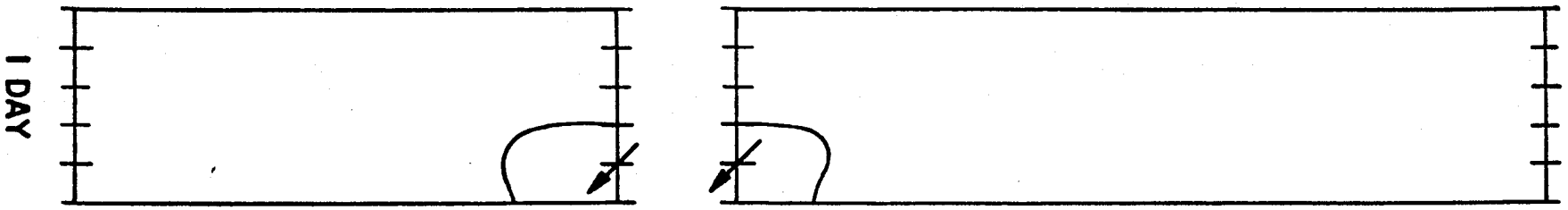
Figure 2B:
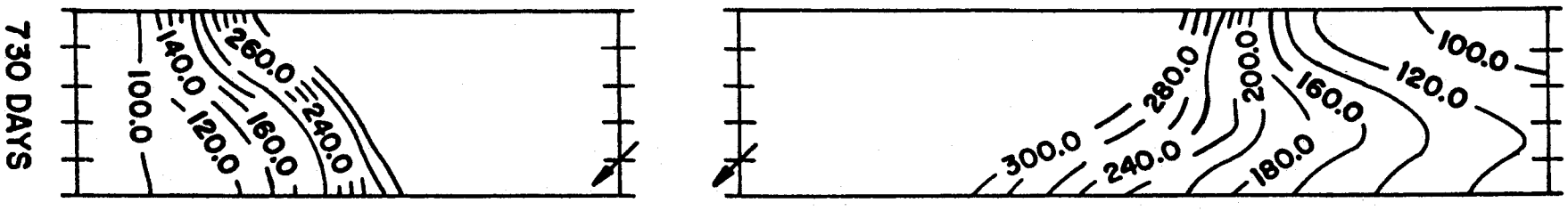
Figure 2C:
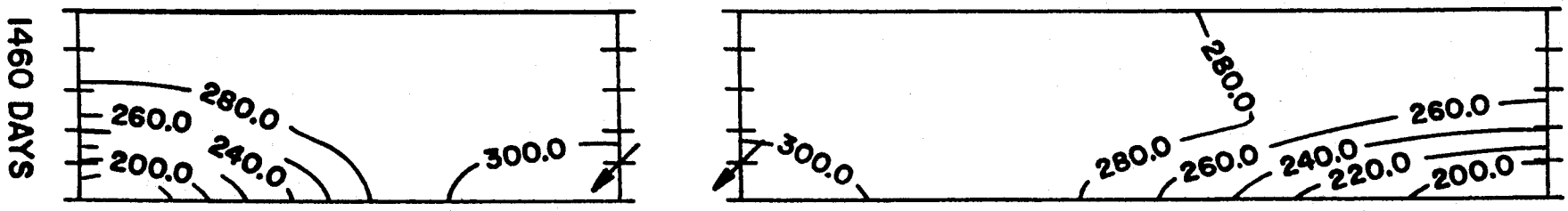

In its broadest aspect, the present invention involves a method of enhanced oil recovery using an inverted nine-spot pattern in an areally homogeneous oil reservoir. The completion of sidewalls in an inverted nine-spot pattern is restricted to the lower 20% of the reservoir to prevent early breakthrough to sidewalls. Preferably, the completion of the wells should be as follows:

| Well | Completion |
|---|---|
| Sidewells | lower 20% |
| Corner wells | more than 20% |
| Center injection well | lower 30% to lower 50% |

More preferably, the completion of the wells should be as follows:

| Well | Completion |
|---|---|
| Sidewells | lower 20% |
| Corner wells | fully complete |
| Center injection well | lower 30% |

By "completion of well," we mean that portion of the wellbore open to flow into or from the reservoir.

By "lower 20% of the reservoir," we mean that interval, measured from the base of the reservoir, which constitutes 20% of the total reservoir thickness.

NUMERICAL SIMULATION STUDY

The invention will be further illustrated by a numerical simulation study that was undertaken to determine the best completion scheme for the sidewall in an inverted nine-spot pattern. That study was first reported by the present inventors in SPE Paper 21754 "Effect of Sidewell Completion on Steamflood Performance of Inverted Nine-Spot Patterns" presented at the 1991 California Regional Meeting of SPE on Mar. 20–22, 1991. While that study is provided to illustrate the present invention, the study is not intended to limit the present invention.

Simulation results showed that completing the sidewall across the bottom 20% of the target interval produces the largest cumulative oil at the lowest cumulative steam-oil ratio. This completion scheme was found to be best regardless of the pattern size (2.5 or 5.0 acres) and the initial reservoir temperature (90° or 200° F.).

Reservoir and Fluid Models

Reservoir Grid

The reservoir model was an areal 7×4 grid system representing one-eighth of an inverted nine-spot pattern. Pattern areas of 2.5 and 5.0 acres were selected. For a 5-acre pattern, the distance between the injector and producer is 330 ft. The area was divided into seven blocks in the x-direction, parallel to the line between the injector and producer, and four blocks in the y-direction. Apex cells at the three corners of the triangle were combined with blocks adjoining them, resulting in a total of 22 active blocks in each layer.

The reservoir with a gross thickness of 75 ft was divided equally into five communicating layers, each 15-ft thick. Steam was injected into the two bottom layers in all cases except the last two, in which the injector was fully completed. The corner producer was fully completed in all cases, while the sidewell completion was varied from bottom one-fifth to full five-fifths.

Reservoir Properties

Table 1 shows important reservoir parameters used in the simulation study. The reservoir was assumed to have uniform properties. It has a horizontal permeability of 4000 md and a vertical permeability of 2000 md. For studying the effect of an intermediate shale on steamflood performance, the vertical permeability of the middle layer was varied from one-half of the horizontal permeability to zero. The temperature-dependent irreducible saturation and endpoint relative permeability data are given in Table 1.

TABLE 1

Reservoir and Fluid Properties Used in Simulation

| | |
|---|---|
| Model grid for ⅛ of inverted 9-spot | 7 × 4 × 5 |
| Distance between injector and producer, ft (5-acre pattern) | 330 |
| Sand thickness, ft | 75 |
| Initial pressure at model center, psia | 31 |
| Initial reservoir temperature, °F. | 90 or 200 |
| Porosity, % | 30.0 |
| Horizontal permeability, md | 4000 |
| Vertical permeability, md | 2000 |
| Initial water saturation (oil zone), % | 48.0 |
| Initial oil saturation (oil zone), % | 50.0 |
| Initial OIP (5-acre pattern), MSTB | 492 |
| Oil viscosity, cp: | |
| at 75° F. | 4200 |
| at 500° F. | 1.6 |
| Compressibility: | |
| water, $psi^{-1} \times 10^{-6}$ | 3.1 |
| oil, $psi^{-1} \times 10^{-6}$ | 5.0 |
| formation, $psi^{-1} \times 10^{-6}$ | 75 |
| Formation heat capacity, Btu/ft³-°F. | 35 |
| Formation thermal conductivity, Btu/ft-D-°F. | 38.4 |

Temperature-Dependent Irreducible Saturation & Endpoint Relative Permeability

| Temp. °F. | $S_{wc}$ | $S_{gc}$ | $S_{orw}$ | $S_{org}$ | $k_{rwro}$ | $k_{rocw}$ | $k_{rgro}$ |
|---|---|---|---|---|---|---|---|
| 90 | 0.450 | 0.0 | 0.260 | 0.310 | 0.050 | 1.000 | 0.100 |
| 400 | 0.500 | 0.0 | 0.130 | 0.100 | 0.050 | 1.000 | 0.100 |

Nomenclature

| | |
|---|---|
| $k_{rg}$ = | relative permeability to gas |
| $k_{rgro}$ = | relative permeability to gas at residual oil saturation |
| $k_{rog}$ = | relative permeability to oil in gas/oil system |
| $k_{rocw}$ = | relative permeability to oil at connate water saturation |
| $k_{row}$ = | relative permeability to oil in water/oil system |
| $k_{rw}$ = | relative permeability to water |
| $k_{rwro}$ = | relative permeability to water at residual oil saturation |
| r = | discount rate, %/yr |
| $S_{gc}$ = | critical gas saturation |
| $S_{wc}$ = | connate water saturation |
| $S_L$ = | liquid saturation |
| $S_{org}$ = | residual oil to gasflood |
| $S_{orw}$ = | residual oil to waterflood |
| $\mu_g$ = | gas viscosity, cp |

Fluid Properties

The oil was assumed to be composed of two components: methane and a dead oil with a gravity of 14° API and a molecular weight of 400. A small amount of methane, 1.5 mole % in the oil phase, was used to initialize the reservoir with a specified gas saturation (2%).

Oil viscosities at two endpoint temperatures, 75° and 500° F., are given in Table 1. Viscosities at other temperatures were obtained from these two values on a standard viscosity-temperature chart, and were input to the simulator in tabular form.

The gas phase viscosity was calculated by the simple relationship: $\mu_g = 0.0136 + 2.112 \times 10^{-5}$ (T-32) cp, where T is temperature in °F. The viscosity data calculated by this relationship were also input to the simulator in tabular form.

Steam Injection Simulator

Chevron's steam injection simulator, SIS3, was employed in this simulation study. The simulator is a fully-implicit, compositional, three-dimensional, numerical model capable of simulating waterflooding, steam stimulation, and steamflooding. The model considers the viscous, gravity, and capillary forces affecting mass transport in the reservoir. Heat transport by conduction and convection within the formation is modeled as well as conductive heat losses to the overburden and underlying strata.

Results

Based on that study, the following conclusions apply to the completion of sidewells in steamfloods using inverted nine-spot patterns:

1. In homogeneous reservoirs with good vertical permeability, steamflood performance is enhanced by restricting the sidewell completion to the lower 20% of the reservoir.
2. To optimize oil recovery and steam-oil ratio, the partially-completed sidewells should be placed on production at the start of the steamflood.
3. The mode and timing of the preferred sidewell completion scheme is insensitive to pattern area (2.5 or 5.0 acre) and initial reservoir temperature (90° or 200° F.).
4. The presence of an intermediate shale with reduced vertical permeability decreases and delays steamflood oil recovery. When the permeability of the shale is not excessively low, best performance is still obtained when the sidewell is partially-completed across the lower 20% of the reservoir.
5. When the intermediate shale is completely sealing (i.e., $k_v/k_h=0$), steamflood oil recovery is improved by fully completing the sidewell across the entire reservoir. Performance is further improved, under these conditions, by fully completing the steam injector.

In all cases studied, steam was injected at a constant rate of 1.5 B/D cold water equivalent (CWE) per acre-ft of reservoir volume. This rate translates to 281 and 563 B/D CWE, respectively, for the 2.5- and 5.0-acre patterns. The majority of the results discussed in this paper pertain to the 5.0-acre pattern. Steam quality was constant at 50%; reference injection pressure at the sandface was 300 psia. Both the corner well and sidewell were assumed to produce at a limiting bottomhole pressure of 14.7 psia, representing a pumped-off condition.

The effect of sidewell completion on steamflood performance was studied by varying the sidewell completion interval from bottom one-fifth to full five-fifths. From an analysis of the simulation results, the optimum completion scheme that yields the largest cumulative oil volume at the lowest comulative steam-oil ratio (SOR) was determined. Subsequently, the sensitivity of the optimum completion scheme to other reservoir and operating parameters was investigated. The parameters varied included timing of the sidewell completion, injection well completion scheme, and initial reservoir temperature.

Effect of Sidewell Completion

Table 2 summarizes the simulation results for a reservoir initially at 90° F. The project life column shows the time of injectin at which the instantaneous steam-oil ratio (SOR) reaches 10; considered to be the economic limit in this study. The cumulative oil production and SOR are those obtained at the economic limit.

TABLE 2

Simulation Results Summary
Effect of Sidewell Completion on Steamflood Performance
Initial Reservoir Temperature = 90° F.
In all cases, injector completed at bottom 2/5

| Mode of Side-well Completion | Project. Life to SOR of 10 | Cum Prod MSTB | Cum Rec % OIP | CUM SOR |
|---|---|---|---|---|
| 5.0-Acre Inverted Nine-Spot | | | | |
| Fully complete at time 0 | 5.59 | 292.8 | 60.4 | 3.92 |
| Bottom 1/5 | 4.88 | 312.8 | 63.5 | 3.17 |
| Bottom 2/5 | 4.92 | 307.2 | 62.4 | 3.28 |
| Bottom 3/5 | 5.13 | 300.8 | 61.1 | 3.50 |
| Fully complete at one year | 5.45 | 294.4 | 58.7 | 3.80 |
| Fully complete at two years | 4.96 | 292.0 | 59.3 | 3.50 |
| 2.5-Acre Inverted Nine-Spot | | | | |
| Fully complete at time 0 | 4.70 | 140.8 | 56.9 | 3.44 |
| Bottom 1/5 | 4.31 | 150.4 | 61.0 | 2.82 |
| Bottom 2/5 | 4.25 | 145.6 | 59.3 | 2.99 |
| Bottom 3/5 | 4.25 | 143.2 | 58.1 | 3.12 |
| Fully complete at one year | 4.65 | 140.0 | 56.8 | 3.41 |
| Fully complete at two years | 4.37 | 140.0 | 56.9 | 3.21 |

The results show that completing the sidewell across the bottom 20% (one-fifth) of the target interval produces the largest cumulative oil at the lowest SOR of all completion schemes considered, and hence is the optimum. This is true for both 2.5- and 5.0-acre patterns, showing the optimum completion to be insensitive to the pattern size. The cumulative oil production as percent of oil initially in place (OIP), however, is higher for the 5.0-acre pattern.

The relative merits of production acceleration and increased recovery must be considered when deciding which completion scheme is best for a given project. This was done by using time-discounted cumulative oil production as the objective function to be maximized. Discounted oil production, rather than discounted cash flow, was selected as the objective function because of the uncertainty associated with oil pricing. Table 3 presents the discounted cumulative production computed at three different discount rates (0, 5, and 10%) for all completion schemes considered. A continuous discounting method was used. The 0% discount rate represents no discounting; hence, the 0% column values are identical to those shown in Table 2.

TABLE 3

Discounted Cumulative Production
Effect of Sidewell Completion on Steamflood Performance
Initial Reservoir Temperature = 90° F.
In all cases, injector completed at bottom 2/5

| Mode of Side-well Completion | Project. Life to SOR of 10 | Discounted Cum Prod (MSTB) r = 0% | r = 5% | r = 10% |
|---|---|---|---|---|
| 5.0-Acre Inverted Nine-Spot | | | | |
| Fully complete at time 0 | 5.59 | 292.8 | 259.2 | 231.0 |
| Bottom 1/5 | 4.88 | 312.8 | 273.9 | 241.2 |
| Bottom 2/5 | 4.92 | 307.2 | 271.0 | 240.5 |
| Bottom 3/5 | 5.13 | 300.8 | 266.4 | 237.4 |
| Fully complete at one year | 5.45 | 294.4 | 260.3 | 231.7 |
| Fully complete at two years | 4.96 | 292.0 | 258.3 | 229.8 |
| 2.5-Acre Inverted Nine-Spot | | | | |
| Fully complete at time 0 | 4.70 | 140.8 | 126.7 | 114.6 |
| Bottom 1/5 | 4.31 | 150.4 | 133.7 | 119.4 |
| Bottom 2/5 | 4.25 | 145.6 | 130.9 | 118.2 |
| Bottom 3/5 | 4.35 | 143.2 | 129.1 | 117.0 |
| Fully complete at one year | 4.65 | 140.0 | 125.8 | 113.7 |
| Fully complete at two years | 4.37 | 140.0 | 125.4 | 112.8 |

The results of Table 3 show that as the discount rate increases, the differences in discounted cumulative production among different completion schemes diminish. Still, completing the sidewell across the bottom one-fifth produces the largest discounted cumulative production and hence is the optimum. In addition, this completion scheme yields the lowest undiscounted cumulative SOR. Therefore, it can be concluded that partially completing the sidewell across the bottom one-fifth of the target interval produces the largest discounted and undiscounted cumulative production at the lowest undiscounted cumulative SOR.

Temperature contours presented in FIGS. 1*a*, 1*b*, 1*c*, 2*a*, 2*b*, and 2*c* explain why partially completing the sidewell yields greater oil production than fully completing it. Shown in FIGS. 1*a*, 1*b*, 1*c*, 2*a*, 2*b*, and 2*c* are temperature profiles on the vertical planes connecting the injector with the sidewell (to the left) and the corner well (to the right). They were generated by the simulator for two situations: bottom one-fifth completion (columns 1 and 2 of FIGS. 1*a*, 1*b*, and 1*c*) and full completion (columns 1 and 2 of FIGS. 2*a*, 2*b*, and 2*c*). It can be seen that when the sidewell is fully completed, steam override promotes early steam breakthrough to the sidewell (i.e., before 1095 days). This results because the distance from the injector to the sidewell is shorter than that to the corner well. After the steam breakthrough, steam propagation to the corner well slows, resulting in reduced areal and vertical coverage by injected steam.

As shown on the two columns of FIG. 1*a*, 1*b*, and 1*c*, completing the sidewell at the bottom one-fifth increases the distance for steam to travel from the injector to the completed lower part of the sidewell. As a result, steam breaks through to the sidewell later and at about the same time as when it breaks through to the corner well. This improves the areal and vertical coverage by steam and produces higher oil recovery at the limiting SOR. In addition, the steam zone temperature is higher for the partial completion case, resulting in a greater reduction of residual oil saturation and higher oil recovery.

Timing of Sidewell Completion

The delayed steam breakthrough to the sidewell by partially completing it, as discussed above, suggests that perhaps the same result can be obtained by delaying the opening of the sidewell, but fully completing it. This is considered to promote steam propagation toward the corner well before the sidewell is open for production. To test this hypothesis, two additional cases were simulated: 1- and 2-year delays in completion of the sidewell.

The results are presented in Tables 2 and 3. The cumulative recovery at the limiting SOR, is about the same regardless of the timing of completion. Furthermore, discounted cumulative production is not noticeably changed by delaying the sidewell completion, as shown in Table 3. This indicates that when steamflooding with inverted nine-spot patterns, if all wells were drilled at the beginning of the project, there is no benefit in delaying completion of the sidewell.

Effect of Initial Reservoir Temperature

The above results were obtained for a reservoir initially at 90° F. There are, however, situations where the temperature is higher before steam injection is started. This situation can occur if the reservoir is heated from below by hotplate heating during steamflooding of a lower sand.

To determine the sensitivity of the optimum completion scheme to initial reservoir temperature, all cases previously considered were rerun for a reservoir initially at 200° F. It should be noted that the results obtained for the new situation are also applicable to light oil steamflood situations because the main effect of increasing the initial reservoir temperature is to reduce the viscosity of the heavy oil to that of a light oil.

TABLE 4

Simulation Results Summary
Effect of Sidewell Completion on Steamflood Performance
Initial Reservoir Temperature = 90° F.
In all cases, injector completed at bottom 2/5

| Mode of Sidewell Completion | Project. Life to SOR of 10 | Cum Prod MSTB | Cum Rec % OIP | CUM SOR |
|---|---|---|---|---|
| 5.0-Acre Inverted Nine-Spot | | | | |
| Fully complete at time 0 | 2.15 | 273.6 | 58.1 | 1.61 |
| Bottom 1/5 | 2.35 | 292.0 | 62.0 | 1.65 |
| Bottom 2/5 | 2.19 | 284.8 | 60.5 | 1.74 |
| Bottom 3/5 | 2.15 | 280.0 | 59.5 | 1.57 |
| Fully complete at one year | 2.17 | 276.0 | 58.7 | 1.61 |
| Fully complete at two years | 2.41 | 287.2 | 61.1 | 1.72 |

TABLE 4-continued

Simulation Results Summary
Effect of Sidewell Completion on Steamflood Performance
Initial Reservoir Temperature = 90° F.
In all cases, injector completed at bottom 2/5

| Mode of Sidewell Completion | Project. Life to SOR of 10 | Cum Prod MSTB | Cum Rec % OIP | CUM SOR |
|---|---|---|---|---|
| 2.5-Acre Inverted Nine-Spot | | | | |
| Fully complete at time 0 | 1.77 | 132.8 | 56.5 | 1.36 |
| Bottom 1/5 | 1.82 | 140.0 | 59.5 | 1.33 |
| Bottom 2/5 | 1.76 | 137.6 | 58.5 | 1.31 |
| Bottom 3/5 | 1.74 | 136.0 | 57.6 | 1.32 |
| Fully complete at one year | 1.73 | 132.0 | 56.0 | 1.35 |
| Fully complete at two years | 2.23 | 140.8 | 59.8 | 1.62 |

Table 4 summarizes the simulation results for a reservoir preheated to 200° F. before steam injection. It shows that completing the sidewell across the bottom 20% (1/5) of the target interval produces the largest cumulative oil of all cases considered with the sidewell open at time 0. This is true for both 2.5- and 5.0-acre patterns. The project life and cumulative SOR, on the other hand, are quite similar to one another (maximum differences of 0.2 years and 0.17, respectively) and hence are not as discriminating as they were in the unpreheated cases. Therefore, based on comparison of the cumulative oil recovery alone, completing the sidewell across the bottom one-fifth appears to be optimum. This conclusion is the same as that for the 90° F. reservoir.

While the present invention has been described with reference to specific embodiments, this application is intended to cover those various changes and substitutions that may be made by those skilled in the art without departing from the spirit and scope of the appended claims.

What is claimed is:

1. A method of enhanced oil recovery in an areally homogeneous oil reservoir comprising:
   (a) injecting steam in a pattern having a steam injection well at the center of the pattern, a production well at each of the four corners of the pattern, and a production well at the center of each side of the pattern, and
   (b) producing oil from sidewells and corner wells of the pattern,
   wherein the completion of the sidewells is restricted to the lower 20% of the reservoir.

2. A method according to claim 1 wherein the completion of the corner wells are more than 20% complete.

3. A method according to claim 2 wherein the completion of the corner wells are fully complete.

4. A method according to claim 1 wherein the completion of the injection well is restricted to the range of the lower 30% to the lower 50% of the reservoir.

5. A method according to claim 4 wherein the completion of the injection well is restricted to the lower 30% of the reservoir.

* * * * *